United States Patent [19]

Skowronski et al.

[11] 4,402,423

[45] Sep. 6, 1983

[54] DIE SET PACKAGING SYSTEM

[75] Inventors: Roman L. Skowronski, Bay Village; John M. Szekeres, Parma, both of Ohio

[73] Assignee: Emerson Electric Co., St. Louis, Mo.

[21] Appl. No.: 224,474

[22] Filed: Jan. 12, 1981

[51] Int. Cl.[3] ..... B65D 25/54

[52] U.S. Cl. ..... 220/345; 220/23.4; 220/23.6; 206/379; 206/806

[58] Field of Search ..... 220/23.2, 23.4, 23.6, 220/23.83; 206/345, 379, 806

[56] References Cited

U.S. PATENT DOCUMENTS

| | | | |
|---|---|---|---|
| 3,219,400 | 11/1965 | Bergquist | 220/23.6 X |
| 3,603,474 | 6/1969 | Erickson | 220/23.4 |
| 3,635,350 | 1/1972 | Wolf | 220/23.4 |
| 3,756,387 | 9/1973 | Chaney | 220/345 X |
| 4,275,943 | 6/1981 | Gelardi et al. | 220/23.4 X |

*Primary Examiner*—Steven M. Pollard

*Attorney, Agent, or Firm*—Polster, Polster and Lucchesi

[57] ABSTRACT

A system of packaging sets of thread cutting dies which are used in pipe and bolt threaders or the like, the system including a display cabinet holding a plurality of die packages without the necessity of having to provide a compartment in the cabinet for each of the die packages. The die packages comprise a one piece box and a top removably fitted on the box. In order to package a wide range of sizes of die sets in the minimum number of boxes, the outside dimensions of the box remain fixed so that the packages can be utilized in the display case and various supports for the die sets are provided internally within the boxes so as to hold various sizes of die sets in position within the box without substantial vertical, lateral or longitudinal movement of the die set relative to the box. The box and the lids are so structured that when the boxes are stacked on one another in the display cabinet, horizontal movement of the stacked boxes relative to one another is prevented.

1 Claim, 20 Drawing Figures

DIE SET PACKAGING SYSTEM

BACKGROUND OF THE INVENTION

This invention relates to a simplified packaging system for machine tool parts, and, more specifically, it relates to a packaging, storage and display system for die sets or other machine tool parts (e.g., cutter wheels, etc.).

Die sets for various thread cutting implements, such as pipe and bolt threaders, come in a variety of sizes and designs, depending on the threads to be cut and the model of the thread cutting implement. Typically, a manufacturer of thread cutting implements offers several different models ranging from manually operated, ratchet-type threaders to motor driven geared threaders. Many of these different gear cutting implement models require different dies and chasers. For example, the Ridge Tool Subsidiary of Emerson Electric Co., assignee of the instant invention, currently manufacturers and sells approximately 760 different die set configurations. These 760 different die sets are now packaged in 220 different cardboard packages or boxes.

Each die set may include four precision machine thread cutting dies. The dies each have sharpened thread cutting edges and are made of suitable tool steel or the like. These thread cutting dies must be adequately protected against damage during shipping and display and also should be protected against corrosion during storage prior to use. Additionally, several different die sets may need to be kept with the threading implement for use to cut different threads and for use on different sizes or diameters of pipe. When a die set is removed from the threading implement, the die should preferably be stored in a suitable container which affords adequate protection to the surface of the thread cutting surfaces of the dies.

As can readily be appreciated, the necessity of making, printing, storing, assembling, and packing some 220 different boxes is a major source of expense and problems for the manufacturer of thread cutting die sets. Further, paperboard boxes oftentimes do not have sufficient crush strength to protect the die sets packaged therein from damage during shipping or storage. Also, paperboard boxes afford little or no protection against moisture and corrosive atmospheres which may cause the die set to rust. Even further, paperboard boxes of varying outside dimensions are often utilized thus making the display and storage of the die set packages difficult. These varied die packages require considerable shelf space in a parts or supply house which sells the die sets to its users. Still further, the use of paperboard boxes oftentimes prevented parts clerks and end users from determining the contents of the box without opening the box. However, the box flaps oftentimes would become torn during opening and closing of the box. Of course, a torn box is not appealing to a customer purchasing quality dies. Also, a variety of stuffers (e.g., wadded, oil impregnated paper) were used to take up excess space in the boxes between the die set and the interior dimensions of the box. However, oftentimes the oil impregnated the stuffer material or the oil applied to the outer surfaces of the die sets would soak through the paperboard boxes and would thus present an unsightly package to the customer. Additionally, paperboard boxes did not seal out corrosive atmospheres from corroding the die sets.

Among the several objects and features of the present invention may be noted the provision of a packaging system for a variety of machine tool parts, such as thread cutting die sets or the like, in which only a few different packages of substantially the same exterior dimensions will accommodate a multiplicity of different sized die sets which formally required a large number of different packages;

The provision of such a packaging system including a rigid container and a removable lid for the container, the container and lid being sufficiently strong to support even a relatively heavy die set and to protect the die set from damage during shipping and storage and protecting the die sets stored therein from moisture and other corrosive elements in the atmosphere;

The provision of such a packaging system in which the containers interlock when stacked thereby making the containers more stable when stacked on a shelf or in a display cabinet;

The provision of such a packaging system in which the contents of such a container may be visually observed without removal of the lid from the container;

The provision of such a packaging system in which the container is substantially air tight when closed thereby to prevent moist air from entering the container and to prevent an oil film on the die set from evaporating;

The provision of a packaging system in which a breakable seal or label is applied to the lid and the container thereby to indicate that the package has or has not been opened;

The provision of such a packaging system in which each of the packages may be stacked vertically one on the other or hung from a hook for display purposes;

The provision of such a packaging system in which a wide variety of sizes and models of die sets may be supported in the package in such manner that the die sets are positively constrained against lateral, longitudinal, and vertical movement within the package;

The provision of such a packaging system which does not require the use of stuffers within the package to hold the die sets against shifting relative to the package;

The provision of such a packaging system in which the lid of the container, when opened, remains attached to the container thereby to prevent inadvertent loss of the lid;

The provision of such a packaging system in which the container may be utilized to store the die sets with the thread cutting implement after initial use of the die sets; and The provision of such a packaging system which is of compact size, which is of durable and yet economical construction, which is inexpensive to manufacture, and which is aesthically pleasing thereby to present the product packaged therein in a favorable light to customers and other users.

Other objects and features of this invention will be in part apparent and in part pointed out hereinafter.

SUMMARY OF THE INVENTION

Briefly stated, the system of this invention is utilized for packaging one or more machine tool parts, such as thread cutting dies or the like, and the system comprises a five-sided, generally rectangular container having a bottom wall, an end wall at each end of the bottom wall, and a side wall at each end of the bottom wall with the top of the container being opened. A lid is provided for closing the open top of the container. The upper edges of the side walls and the bottom of the lid have dovetail tongue and groove means thereon so that with the tongue and groove means being engaged with one another, the lid may be slid in a direction generally parallel to the bottom wall of the container from an open position in which the lid is substantially clear of the open top of the container to a closed position in which the open top of the container is closed by the lid. The upper face of the lid and the bottom face of the bottom wall of the container have means thereon for at least partially interlocking the bottom wall of the container of an upper package with the lid of the lower package when two or more of the packages are stacked vertically.

Further, this invention includes a packaging system for packaging a set of thread cutting dies, the latter having sharpened thread cutting surfaces thereon and a transverse groove in one face thereof, the dies being arranged in side-to-side abutting relation when pakaged within the packaging system of this invention. The latter comprises an open top box of rectangular cross section having a rectangular bottom wall, an end wall at each end of the bottom wall, and a side wall at each side of the bottom wall. The bottom wall has means integral therewith extending upwardly from the bottom wall and extending transversely of the box between the side walls, this last said means being received in the transverse grooves of the dies thereby to locate the dies within the box and to prevent the dies from shifting longitudinally within the box. The box further has a top removably secured to the box at the upper edges of the side walls with the lid being cooperable with the dies thereby to hold the dies against vertical movement within the box.

BRIEF DESCRIPTION OF THE DRAWINGS

Corresponding reference characters indicate corresponding parts throughout the several views of the drawings.

DESCRIPTION OF A PREFERRED EMBODIMENT

Figure 20:
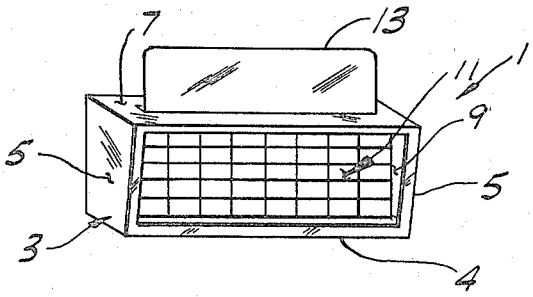
FIG. 20 is a perspective view of a packaging system of the present invention including a display cabinet having a series of stacks (eight vertical stacks) of packages (as shown in FIGS. 1–19 herein).

Referring now to the drawings and particularly to FIG. 20, a packaging and display of the present invention is indicated in its entirety by reference character 1. The display system includes a display cabinet, as generally indicated at 3. The cabinet is preferably made of sheet metal construction and includes a bottom wall 4, side walls 5, a top 7 and a back wall (not shown). The front of the cabinet is open and the various walls of the cabinet define an opening therein as is generally indicated at 9. This opening is sized so as to accommodate an array of product packages or containers, with each of the containers being generally indicated at 11. As shown in FIG. 20, eight vertical stacks of five containers each are enclosed within display cabinet 3 and thus the display cabinet is capable of holding forty containers 11. It will be appreciated, however, that the dimensions of the containers and the size of opening 9 in the display cabinet is optional and may vary widely, depending on the product to be displayed within the containers. Additionally, display cabinet 3 may include a sign, as indicated at 13, carrying desired indicia (not shown) indicating the contents of the display case. Still further, a transparent front cover (not shown) may be utilized to enclose cavity 9 thereby to protect the packages 11 contained within the display cabinet against pilfering. In accordance with this invention, no support structure need be provided within the cabinet for supporting containers 11.

Referring now to FIGS. 1–19, the containers 11 displayed in display cabinet 3 will be hereinafter discussed in detail. More specifically, each container 11 is comprised by a five-sided, open top box, as generally indicated at 15, and by a removable lid 17 which when closed substantially sealably closes off the open mouth or top of the box. In accordance with this invention, the packaging system disclosed herein preferably utilizes four boxes of different internal configurations, as generally indicated herein at 15*a*–15*d*, with the exterior dimensions of the boxes and the lids 19 being identical. These four different embodiments of the box permit the packaging of some 760 different thread cutting die sets, as indicated generally at DS, each set consisting of one or more thread cutting dies D. Since many features of the various boxes 15*a*–15*d* are identical, only box 15*a* and the lid 17 therefor, as shown in FIGS. 1–9, will be initially described. Then, differences between boxes 15*a* and the other boxes 15*b*–15*d* will be more fully hereinafter explained.

As previously mentioned, box 15*a* is a five-sided, open top box including a bottom wall 19, front and rear end walls 21F and 21R, and side walls 23A, 23B. A tab 25 extends out from the front end wall near the bottom of the box and the tab is provided with an opening 27 therethrough. It will be understood that tab 25 serves as a drawer pull when the containers 11 are stacked in display cabinet 3, as shown in FIG. 20, or the tab may serve as a hanging tab when a wire display bracket or the like (not shown) is inserted through opening 27. Thus, the containers 11 of this invention may either be stacked vertically as shown in FIG. 20 or the containers with their products therein may be hung on a rack.

Figure 1:
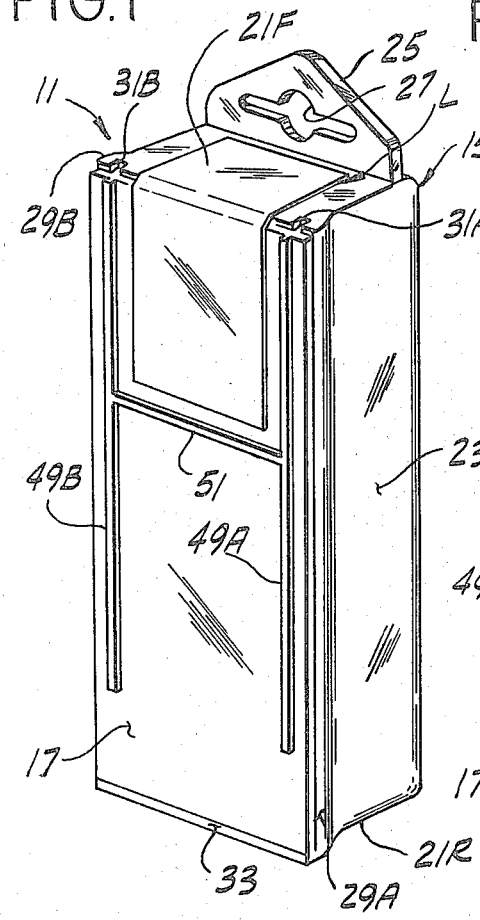
FIG. 1 is a perspective view of a first embodiment of the container utilized in the packaging system of the present invention illustrating the container with its lid closed and with a label applied to one end of the container and to the lid so as to indicate that the container is sealed.
Figure 2:
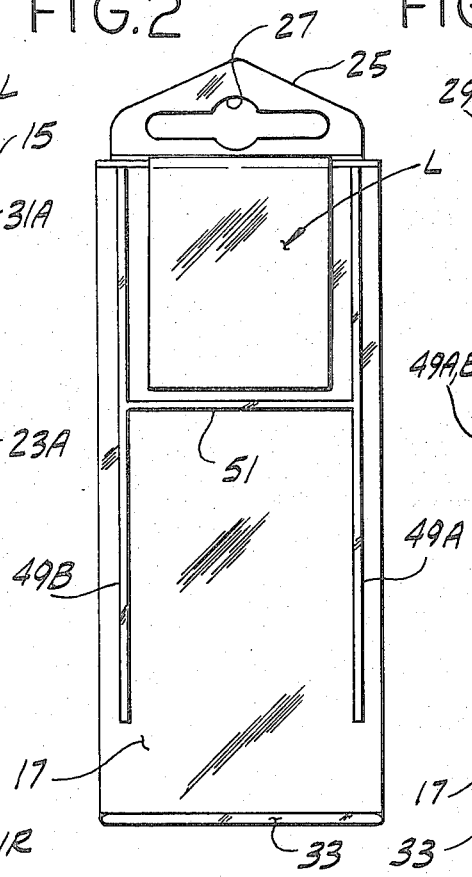
FIG. 2 is a top plan view of the container shown in FIG. 1 with the lid in its closed position.
Figure 3:
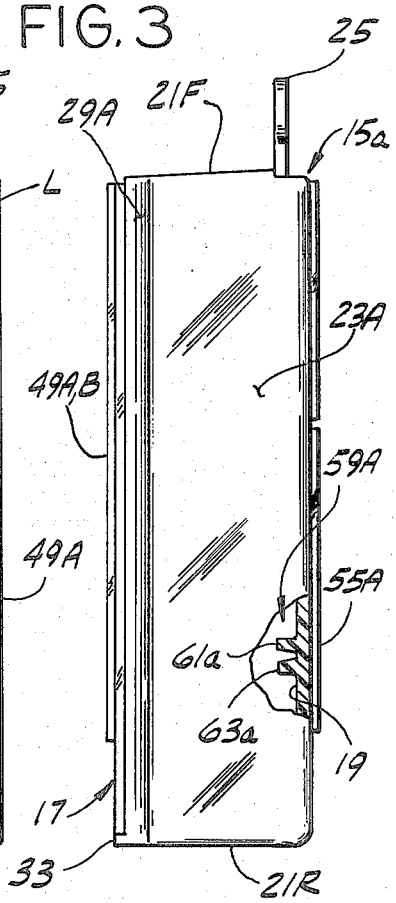
FIG. 3 is a side elevational view of the container shown in FIG. 1 with a portion of the container cut away illustrating means integral with the bottom wall of the container cooperable with a die set to be packaged in the container for preventing longitudinal movement of the die set within the package.
Figure 4:
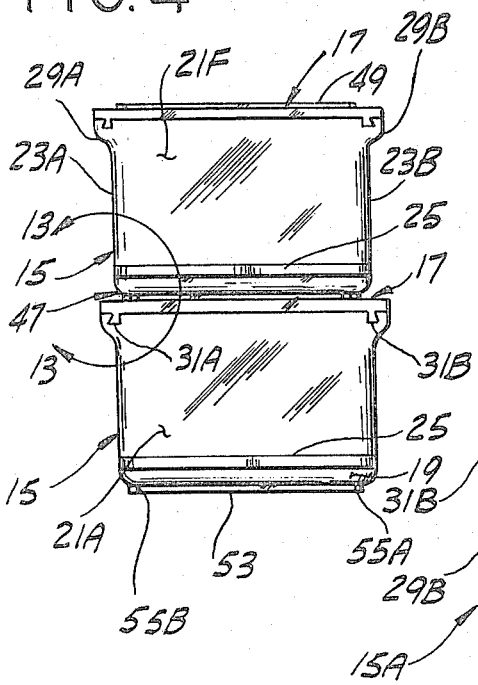
FIG. 4 is a end elevational view of two containers as illustrated in FIGS. 1–3 of the present invention stacked vertically on one another with the bottom of the upper package resting on and in interengagement with the upper face of the lid of the lower package.

Preferably, box 15*a* is a one-piece box molded from a suitable synthetic resin material, such as an opaque high density polyethylene or the like. As best shown in FIGS. 1, 3, and 4, the upper edges of side walls 23A, 23B are enlarged, as indicated at 29A, 29B, respectively. Each of these upper side wall enlargement has a respective longitudinal dovetail groove 31A, 31B (see FIG. 10) molded in place and extending substantially the full length of the side walls. The ends of these dovetail grooves are open at their ends adjacent front end wall 21F. Rear end wall 21R has an extension 33 which extends upwardly above the level of side walls 23A, 23B and this extension serves as an abutment engageable with one end of lid 17 when the lid is in its closed position (as shown in FIGS. 1–3).

Figure 7:
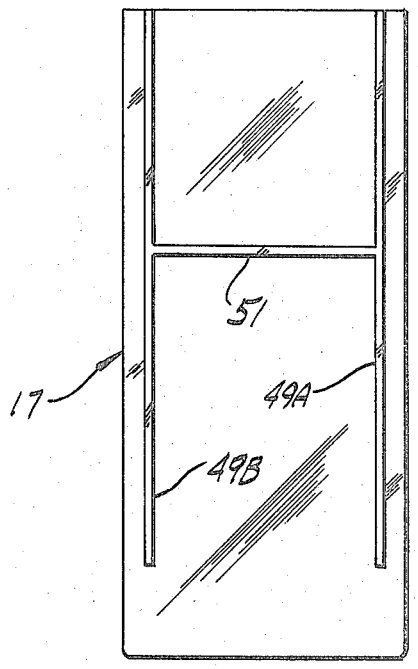
FIG. 7 is a top plan view of the lid.
Figure 8:
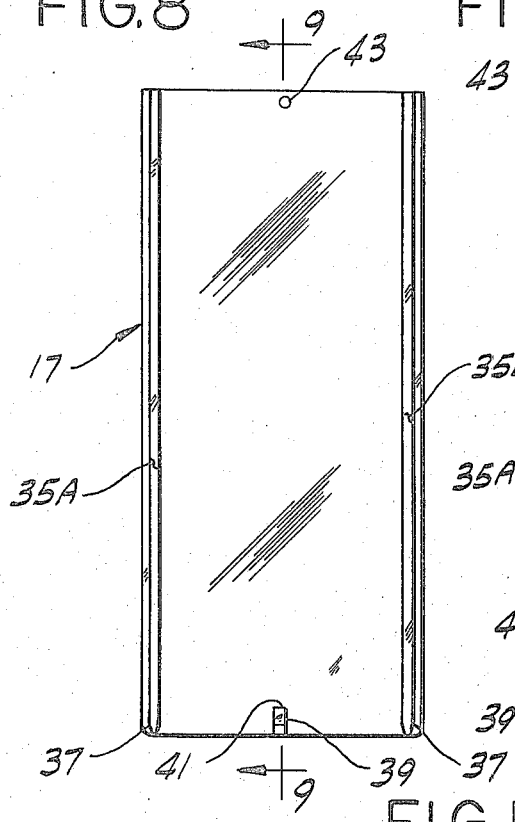
FIG. 8 is a bottom plan view of the lid.
Figure 9:
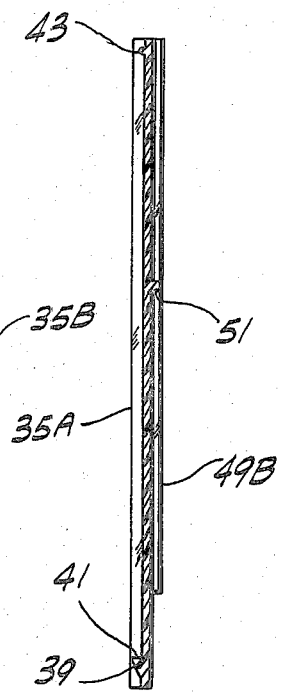
FIG. 9 is a longitudinal cross section view of the lid taken along line 9—9 of FIG. 8.

Referring now particularly to FIGS. 7–9, lid 17 for box 15*a* is shown to be a one-piece unit preferably molded of a suitable transparent synthetic resin material, such as clear impact acrylic or the like. Lid 17 is shown to be a substantially planar member having a pair of the elongate, dovetail flanges 35A, 35B at opposite sides of the lid cast in place and integral with the lid for being snugly received within respective dovetail grooves 31A, 31B provided in the upper edges of side walls 23A, 23B. As indicated at 37 in FIG. 8, the leading ends of flanges 35A, 35B are pointed (tapered) so as to aid the flanges in entering their respective dovetail grooves.

Further, an inclined ramp 39 is molded in place at the center of lid 17 on the underside thereof adjacent the leading end of the lid and this ramp has a rearwardly facing generally perpendicular end face 41 (see FIG. 9). Upon installing the lid on the container, the upper edge of front end wall 21F engages the inclined face 39 of the ramp and upon further movement of the lid toward its closed position, the upper edge of the front end wall moves clear of the ramp. It will be appreciated, however, that upon opening the lid, the perpendicular end face 41 of the ramp will engage the inner face of the front end wall and thereby prevent the lid from being completely removed from box 15 upon opening of the lid. Further, a detent button, as indicated at 43, is cast on the undersurface of the lid 17, this detent button being so positioned on the lid so as to engage the upper edge of the front end wall 21F of the box and to be disposed on the inside thereof in contact with the front end wall when the lid is in its fully closed position thereby to prevent inadvertent opening of the lid.

Figure 6:
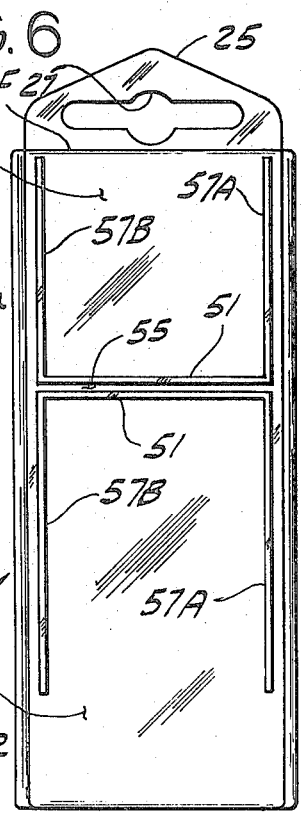
FIG. 6 is a bottom plan view of the container shown in FIGS. 1–3 and 5 with a pattern of raise ribs formed thereon cooperable with a mating pattern formed on the upper surface of the lid of another die package thereby to prevent shifting of the stacked die packages (as shown in FIG. 4) relative to one another.
Figure 13:
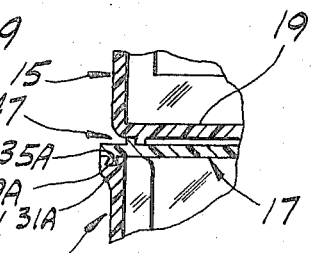
FIG. 13 is a cross sectional view taken along line 13—13 of FIG. 4 illustrating how the means formed on the bottom of the container and the top of the lid cooperate to prevent shifting of stacked containers relative to one another.

In accordance with this invention, means, as generally indicated at 47, is provided on containers 11 for preventing relative horizontal movement of the containers when the containers are stacked vertically one on the other as illustrated in FIGS. 4, 13 and 20. More specifically, means 47 comprises certain cooperating tongue and groove interlocking structures (ribs) provided on the upper faces of lid 17 and the bottom face of bottom wall 19 of the boxes which interengage one another thereby to prevent relative horizontal movement of the stacked boxes relative to one another. As shown in the drawings, a generally H-shaped flange is integrally molded on lid 17 and projects slightly outwardly from the outer face thereof. This H-shaped flange or tongue includes a pair of parallel flanges 49A, 49B extending generally the length of the lid at the outer margins thereof and a cross flange 51 extending between side flanges 49A, 49B intermediate the ends thereof. As best shown in FIG. 6, the groove means provided on the bottom face of bottom wall 19 is defined by a pair of generally U-shaped flanges integrally molded on the bottom face of the bottom wall with the bases of the U-shaped flanges being in generally back-to-back relation and being spaced apart from one another for defining a groove 55 therebetween extending transversly of the box. The arms of the U-shaped flanges, as indicated at 57A, 57B extend generally longitudinally of the box and when the boxes are stacked vertically with one another, the outer edges of the flanges 55A, 55B are disposed to be contiguous to the inner edges of the flanges 49A, 49B provided on the lid. In this manner, the lid cross bar flange 51 is received in groove 55 between base flanges 53 of the flanges provided on the bottom face of bottom wall 19 of the container 11 which is stacked on top of the lid thereby to prevent fore and aft (longitudinal) movement of the stacked containers relative to one another. With flanges 57A, 57B being disposed on the inside of flanges 49A, 49B of the lid flanges, relative side-to-side horizontal movement of the stacked containers, is likewise substantially prevented. In this manner, with containers 11 stacked vertically within cabinet 3 as shown in FIG. 20, it will be understood that the stacked containers are thus made more stable and thus are maintained neatly within the display cabinet. Still further, because the stacked containers 11 are neatly maintained in stacked relation within the container, the necessity of providing individual compartments for containers 11 within the display cabinet is eliminated.

Referring now to FIGS. 3, 5, 10–12, and 14–19, each of the containers 11 of this invention and more particularly boxes 15*a*–15*d*, are each provided with means for engagement with the dies D of the die sets DS housed within the container so as to substantially prevent longitudinal, lateral and vertical movement of the die set with respect to the container and the lid. In this manner, die sets which have length, width or height dimensions substantially smaller than the corresponding interior dimensions of boxes 15*a*–15*d* are positively constrained against movement within the box without the use of filler papers or other stuffers, and, thus, the die sets are positively held or packaged within containers 11. In this manner, the firm restraining of the die sets aids greatly in preventing damage to the die sets within packages 11 in the event the packages are dropped or otherwise mishandled.

Oftentimes, thread cutting dies for use in the pipe and bolt threaders require dies having a transverse slots S extending therethrough in one edge of the die D. Each of the containers 15*a*–15*d* of the present invention includes means, as respectively indicated at 59*a*–59*d*, for reception by the transverse slots S in the dies thereby to prevent longitudinal movement of the dies relative to the boxes. As shown best in FIGS. 3, 5, 10, 11, and 14–16, the above-noted means 59*a*–59*d* consists of a pair of parallel, closely spaced walls 61*a*–61*d* and 63*a*–63*d* integral with the bottom walls 19 of the respective boxes 15*a*–15*d* and extending transversely between and integral with the side walls 23A, 23B of the boxes. In each of the boxes 15*a*–15*d*, the respective pairs of the walls extend up from the bottom of the box a predetermined amount so as to be received in the transverse slots S provided in die sets DS to be supported in the box. In addition, the location of the transverse walls 61*a*–61*d* and 63*a*–63*d* on the bottom wall from one of the end walls (e.g., wall 21R) is such as to be received by the transverse slots S in the dies and to hold the dies in a desired longitudinal position within the box so that a range of die sizes or configurations may be accommodated within the box. It will be understood that the outer faces of walls 61*a*–61*d* and 63*a*–63*d* are spaced apart at a distance to fit snugly within the transverse slots S in the dies to be housed in the boxes. In addition, gussets (not shown) may be molded-in-place between the inner faces of walls 61*a*–61*d* and 63*a*–63*d* so as to maintain the walls parallel to one another without warping.

Figure 5:
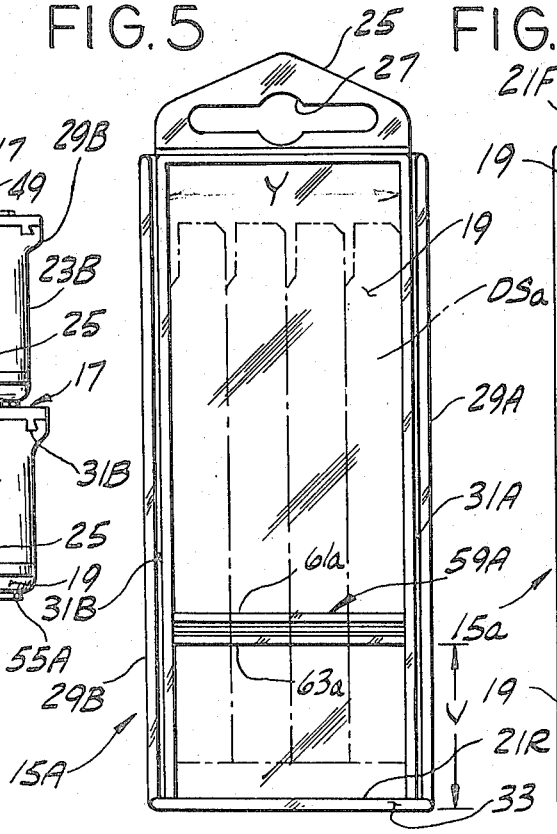
FIG. 5 is a view similar to FIG. 2 with the lid removed and illustrating a die set (shown in phantom) packaged within the container.
Figure 14:
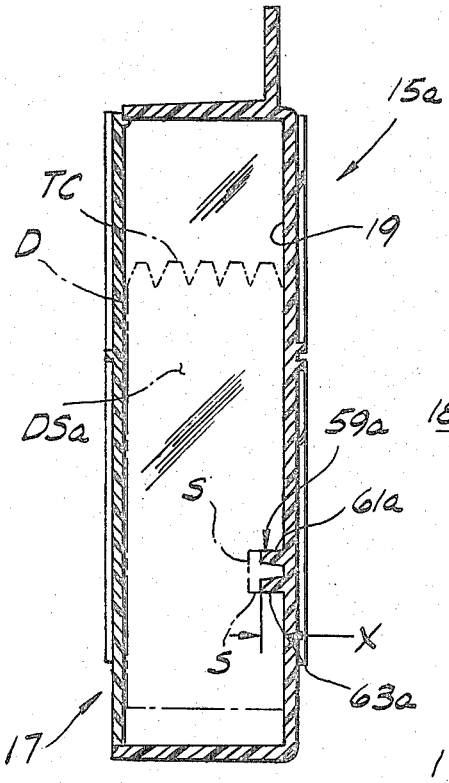
FIG. 14 is a longitudinal cross sectional view of the container shown in FIGS. 2, 3, 5, and 6 and illustrating (in phantom) a die set supported within the container.

Referring now to FIGS. 3, 5 and 14–17, box 15*a* in FIG. 14 is shown to house a die set DSa having four dies D contained therein. Each of these dies is a generally plate-like member of tool steel or the like and, as best shown in FIG. 14, each die has a thread cutting surface TC at one end thereof. The previously-mentioned transverse slot S is provided in each of the dies with this slot being open along one edge of the die. The width of slot S is such that it readily, yet snugly, receives walls 61*a*, 63*a* thereby to hold each of the dies D and thus the die set DSa against longitudinal shifting within box 15*a*. As also shown in FIG. 14, each of the dies D, when installed in box 15*a*, has a height only somewhat less than the depth of the box from the inner face of wall 19 to the upper edges of the side walls. Thus, with top or lid 17 in its closed position, the dies are held firmly within the box and are prevented from moving in heightwise direction within the box. As shown in FIG. 5, the width of the box between side walls 23A, 23B is such that the die set DSa fits snugly within the box and thus the dies are substantially prevented from moving in widthwise direction relative to the box. As also shown in FIG. 5, the box is somewhat longer than each of the dies D and thus the dies can accommodate dies of greater or lesser length of the dies D shown in FIG. 5. It will thus be appreciated that for the range of die set configurations to be packaged in the four box configurations 15*a*–15*d* of this packaging systems, box 15*a* is utilized to store a range of die sizes having the greatest thickness and height. Thus, it is seen that the overall dimensions of boxes 15*a*–15*d* are such as the box is sized to accommodate the largest width and height of the dies to be packaged within the packaging system of the present invention.

Figure 10:
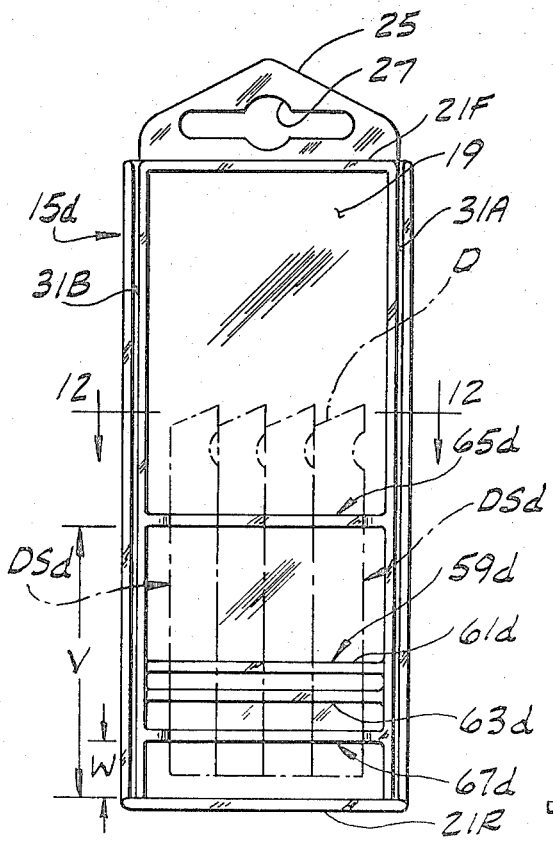
FIG. 10 is a view similar to FIG. 5 illustrating another embodiment of the container of the present invention for packaging a different size of die set (shown in phantom) and further illustrating means integral with the walls of the container for holding the die set against longitudinal, sidewise, and heightwise movement relative to the container.
Figure 15:
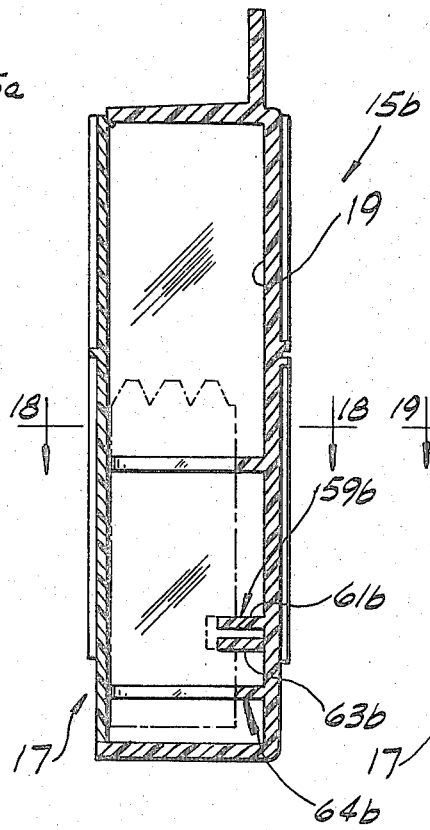
FIG. 15 is a view similar to FIG. 14 illustrating another embodiment of the container for holding still another configuration of die set.
Figure 16:
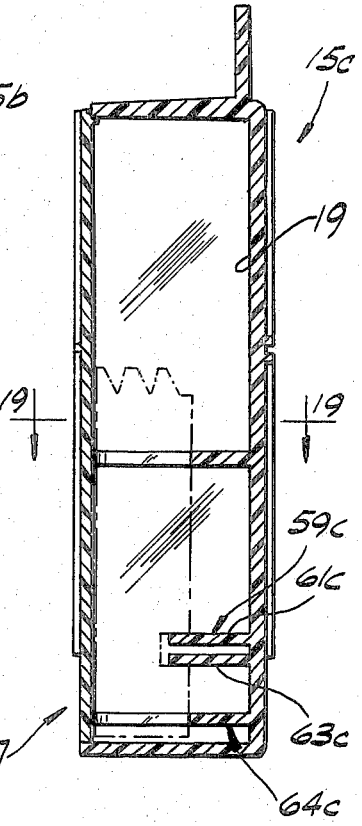
FIG. 16 is a view similar to FIGS. 14 and 15 illustrating still another embodiment of the container of this invention for supporting still another die set configuration.
Figure 17:
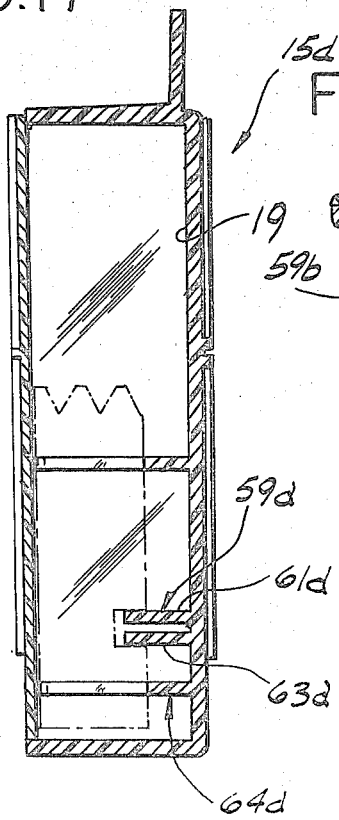
FIG. 17 is a view similar to FIGS. 14–16 illustrating a fourth package configuration for supporting a fourth die set configuration, the package embodiments shown in FIGS. 1–19 being capable of accommodating approximately 760 different die set configurations.
Figure 18:
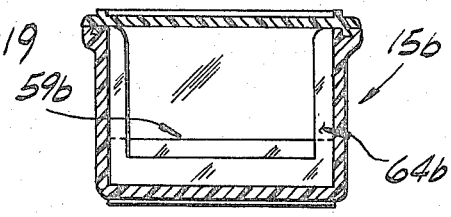
FIG. 18 is a cross sectional view taken along line 18—18 of FIG. 15 illustrating further details of construction of the container embodiment illustrated in FIG. 15.
Figure 19:
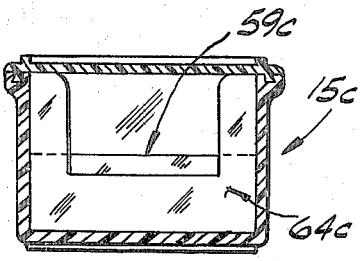
FIG. 19 is a view similar to FIG. 18 taken along line 19—19 of FIG. 16.

Referring now to boxes 15*b*–15*d* as shown in FIGS. 15–17, these other boxes include filler or spacer means, as indicated generally at 64*b*–64*d*, for allowing these other boxes with the same outside dimensions as box 15*a* to accommodate respective die sets DSb–DSd having a lesser width and height than the die sets DSa accommodated in boxes 15*a*. Generally, these filler means support the die sets DSb–DSd above the level of the bottom wall 19 so that the top of these die sets are supported in close proximity to the underside of lid 17. Further, means 64*b*–64*d* also hold the dies in these die sets against shifting laterally within the box. As with box 15*a*, the parallel walls constituting means 59*b*–59*d* are received within the corresponding grooves or slots in the die sets DSb–DSd for preventing longitudinal shifting of the die sets within the box. As shown in FIGS. 10, 15 and 16, the length of the die sets DSb–DSd supported in the other size boxes may be significantly less than the length of the boxes but they are nevertheless held against longitudinal movement within the box.

Figure 11:
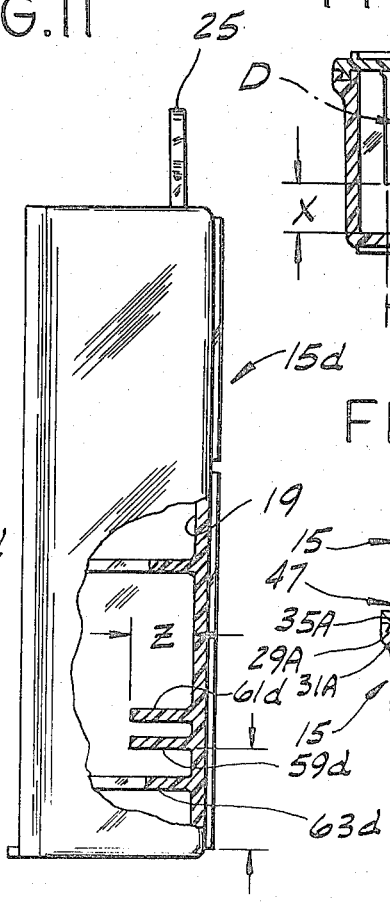
FIG. 11 is a right side elevational view of the container illustrated in FIG. 10 with portions of the side wall broken away so as to illustrate walls integral with the container for holding the die set against longitudinal, sidewise, and heightwise movement.
Figure 12:
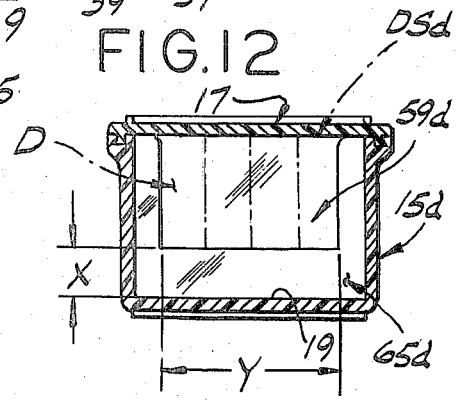
FIG. 12 is a transverse cross sectional view of the container taken along line 12—12 of FIG. 10.

As shown in FIGS. 10–12, in regard to box 15*d*, the above-noted means 64*d* for supporting die sets DSd in position within box 15*d* with the top surfaces of the die set in close proximity to the under surface of lid 17 and with the die set held against lateral movement within the box comprises a pair of generally U-shaped walls 65*d* and 67*d*. Each of these walls has a generally U-shaped opening therein (see FIG. 12) of the same general width and depth of the die set DSd to be contained within the box. As shown in FIG. 10, wall 65*d* is located from end wall 21R by a distance V and wall 67*d* is located from end wall 21R by a distance W. As shown in FIG. 12, walls 65*d* and 67*d* each have the bottom surface of its U-shaped opening located a distance X above bottom wall 19 of the box so as to be engageable with the bottom surfaces of die sets DSd supported in the box thereby to hold the die sets in close proximity to lid 17 when the lid is installed. Further, each of these walls 65*d* and 67*d* has side wall portions integral with and extending inwardly from side walls 23A and 23B a predetermined distance (see FIG. 12) thereby to define the width Y of the U-shaped opening within the walls to generally correspond to the width of the die set DSd. As shown in FIG. 11, wall 61*d* and 63*d* extend up above the bottom wall 19 a distance Z so as to be received in transverse slots S in the die set thereby to prevent axial or longitudinal movement of the die sets within the box.

As an example of one configuration of boxes 15*a*–15*d* in accordance with the packaging system of this invention, the dimensions W-Z for boxes 15*b*–15*d* are shown in Table 1 hereinafter. The four boxes 15a–15d having the same outside dimensions and having the various dimensions, as indicated in Table 1, are capable of accommodating approximately 760 different die set configurations and thus replace some 220 different cardboard boxes now utilized to package the same 760 different die sets.

TABLE I

| Box Configuration | Dimension (Inches) | | | | |
|---|---|---|---|---|---|
| | V | W | X | Y | Z |
| 15a | .92 | — | — | 1.516 | .110 |
| 15b | 1.770 | .329 | .187 | 1.25 | .297 |
| 15c | 1.770 | .204 | .437 | 1.00 | .547 |
| 15d | 1.770 | .329 | .312 | 1.25 | .422 |

As shown in FIG. 1, an adhesive-backed label, as indicated at L, is affixed to the front face of front end wall 21F and to the top surface of lid 17. This label may carry indicia indicating the contents of the package. Additionally, with the label adhered both to the lid and to the box, the label firmly and positively holds the lid in its closed position and seals the lid relative to the box. By cutting through the label so as to permit opening of the lid, the label or seal is broken thus indicating that the box has been opened. Of course, with the label intact, customers purchasing die sets will feel assured that they are obtaining factory fresh products.

In view of the above, it will be seen that other objects of this invention and other advantageous results obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A system for packaging one or more machine tool parts, such as thread cutting dies or the like, comprising a plurality of packages, each package comprising a generally rectangular container having a bottom wall, an end wall at each end of the bottom wall, and a side wall at each side of the bottom wall, the top of the container being open, and a lid for closing the open top of the container, the upper edges of said side walls and the bottom of said lid having dovetail tongue and groove means so that upon said tongue and groove means being engaged with one another, the lid is slidable in a direction generally parallel to the bottom wall of the container from an open position in which the lid is substantially clear of the open top of the container to a closed position in which the open top of the container is closed by the lid, the upper face of the lid and the bottom face of the bottom wall of the container of said packages of the said packaging system having means thereon for at least partially interlocking the bottom wall of the container of an upper package with the lid of the lower package when two or more of the packages are stacked vertically, said package interlocking means comprising receptacle and protuberance means on the container bottom wall and on the lid with the protuberance means of one package being received in the receptacle means of another package, said interlocking means preventing sidewise, endwise, and rotational movement of one stacked package relative to another, wherein said receptacle means comprises two generally U-shaped ribs extending out from the bottom surface from the bottom wall of the container with the bases of said U-shaped ribs being parallel and transverse to the sides of the container with these bases of the U-shaped ribs being spaced apart from one another, and wherein said protruberance means comprises a generally H-shaped rib formed on the upper surface of the lid with a cross rib of H-shaped protruberance rib being received between the parallel bases of the U-shaped rib of the receptacle means and with the inner faces of the H-shaped rib being engageable with the outer faces of the U-shaped receptacle ribs thereby to prevent lateral, longitudinal and rotational movement of one stacked package relative to another.

* * * * *